US011459163B2

(12) United States Patent
Hildebrandt

(10) Patent No.: US 11,459,163 B2
(45) Date of Patent: Oct. 4, 2022

(54) HYDRATION SQUIRT BOTTLE

(71) Applicant: Chi Wen Hildebrandt, Orangevale, CA (US)

(72) Inventor: Chi Wen Hildebrandt, Orangevale, CA (US)

( * ) Notice: Subject to any disclaimer, the term of this patent is extended or adjusted under 35 U.S.C. 154(b) by 126 days.

(21) Appl. No.: 17/141,488

(22) Filed: Jan. 5, 2021

(65) Prior Publication Data

US 2022/0212859 A1 Jul. 7, 2022

(51) Int. Cl.

| | |
|---|---|
| ***B65D 83/00*** | (2006.01) |
| ***B65D 85/72*** | (2006.01) |
| ***B65D 43/02*** | (2006.01) |
| ***A45F 3/16*** | (2006.01) |

(52) U.S. Cl.

CPC ..... *B65D 83/0011* (2013.01); *A45F 3/16* (2013.01); *B65D 43/0231* (2013.01); *B65D 85/72* (2013.01)

(58) Field of Classification Search

CPC ..... B65D 83/0011; B65D 83/0027; B65D 83/0022; B65D 83/0033; B65D 83/0005; B65D 43/0231; B65D 43/0227; B65D 85/72; A45F 3/16

USPC ..... 222/390, 391, 386; 220/703; 215/387

See application file for complete search history.

(56) References Cited

U.S. PATENT DOCUMENTS

| | | | | |
|---|---|---|---|---|
| 2,199,877 A * | 5/1940 | Cervera | B65D 83/0011 401/172 |
| 2,745,575 A * | 5/1956 | Spencer | F16N 3/12 222/327 |
| 4,269,331 A * | 5/1981 | Watson | B65D 83/0011 74/424.78 |
| 2014/0197171 A1* | 7/2014 | Taylor | B65D 83/0027 220/288 |
| 2018/0020808 A1* | 1/2018 | Villarreal | A45D 40/04 401/126 |
| 2019/0255305 A1* | 8/2019 | Hendriks | A61K 8/36 |

FOREIGN PATENT DOCUMENTS

WO WO 03/057581 A1 * 7/2003

* cited by examiner

*Primary Examiner* — Lien M Ngo
(74) *Attorney, Agent, or Firm* — Craig A. Simmermon

(57) ABSTRACT

Hydration squirt bottle is a squirt bottle with a special plunger actuator collar that is pivotally attached to a special plunger and mechanically linked to a special barrel or container wherein rotation of the plunger actuator collar relative to the barrel causes the plunger to move laterally into a barrel in order to cause liquid stored inside the barrel to squirt out from a spout on a cap. This invention helps older people or any other types of people that have difficulty staying hydrated or drinking fluid by squirting the water or beverage into the person's mouth through positive pressure, without the need for the person to drink from a standard cup or glass by sucking water from the cup or glass. In best mode, the squirt bottle is calibrated to squirt the exact amount of 20 cubic centimeters of water or beverage into the person's mouth per every one complete rotation of the plunger actuator collar.

1 Claim, 5 Drawing Sheets

HYDRATION SQUIRT BOTTLE

BACKGROUND OF THE INVENTION

1. Field of the Invention

This invention relates to a squirt bottle or container for drinking water or any other beverage and more specifically to a squirt bottle that creates positive pressure inside the bottle or container to squirt the water or beverage out of a spout on the bottle or container when a plunger actuator collar is rotated to retract a plunger which creates internal pressure to cause the water or beverage to squirt out from the spout.

2. Description of Related Art

There are other squirt bottles in the prior art however there are none as shown and described here that include a special plunger actuator collar that is pivotally attached to a special plunger and mechanically linked to a special barrel or container wherein rotation of the plunger actuator collar relative to the barrel causes the plunger to move laterally into a barrel in order to cause liquid stored inside the barrel to squirt out from a spout on a cap. This invention helps older people or any other types of people that have difficulty staying hydrated or drinking fluid by squirting the water or beverage into the person's mouth through positive pressure, without the need for the person to drink from a standard cup or glass by sucking water from the cup or glass. A care giver or other health care profession could operate this invention by holding the spout up to the person's mouth and rotating the plunger actuator collar to squirt the water or beverage into the person's mouth, wherein the person would then swallow the water or beverage. Alternately, the person taking the drink could operate this invention by himself or herself by holding the spout up to their own mouth and rotating the plunger actuator collar to squirt the water or beverage into their mouth. In best mode, the squirt bottle is calibrated to squirt the exact amount of 20 cubic centimeters of water or beverage into the person's mouth per every one complete rotation of the plunger actuator collar.

BRIEF SUMMARY OF THE INVENTION

It is an aspect of hydration squirt bottle to include a special plunger actuator collar that is pivotally attached to a special plunger wherein rotation of the plunger actuator collar causes the plunger to move laterally into a special barrel or container in order to cause liquid stored inside the barrel or container to squirt out from a spout on a cap.

It is an aspect of hydration squirt bottle to include a special barrel or container that is mechanically linked to the plunger actuator collar.

It is an aspect of the plunger actuator collar to include helical thread on its interior surface that engages with distal exterior thread on the barrel.

It is an aspect of the barrel or container to include distal exterior thread that engages with helical thread on the inside of plunger actuator collar.

It is an aspect of the plunger to include a screw flange that is pivotally attached to the plunger actuator collar.

It is an aspect of the plunger to include a special plunger seal that makes a press fit or interference fit with the inside diameter of the barrel.

It is an aspect of hydration squirt bottle to include a cap with a spout.

It is an aspect of hydration squirt bottle to squirt water or beverage contained within the barrel out of the spout as the plunger actuator collar is rotated clockwise relative to the barrel.

It is an aspect of hydration squirt bottle to suck water or beverage in through the spout and into the barrel as the plunger actuator collar is rotated counterclockwise relative to the barrel.

It is an aspect of best mode hydration squirt bottle to be easily dissembled into its components by hand without any tools and washed in a dishwasher.

It is an aspect of hydration squirt bottle to be easily assembled from its components by hand without any tools.

It is an aspect of the plunger seal to be replaceable after the plunger seal wears out.

BRIEF DESCRIPTION OF THE DRAWINGS

FIG. 1 also defines cross sectional plane 3-3.

FIG. 2 also defines cross sectional plane 4-4.

DEFINITION LIST

Figure 1:
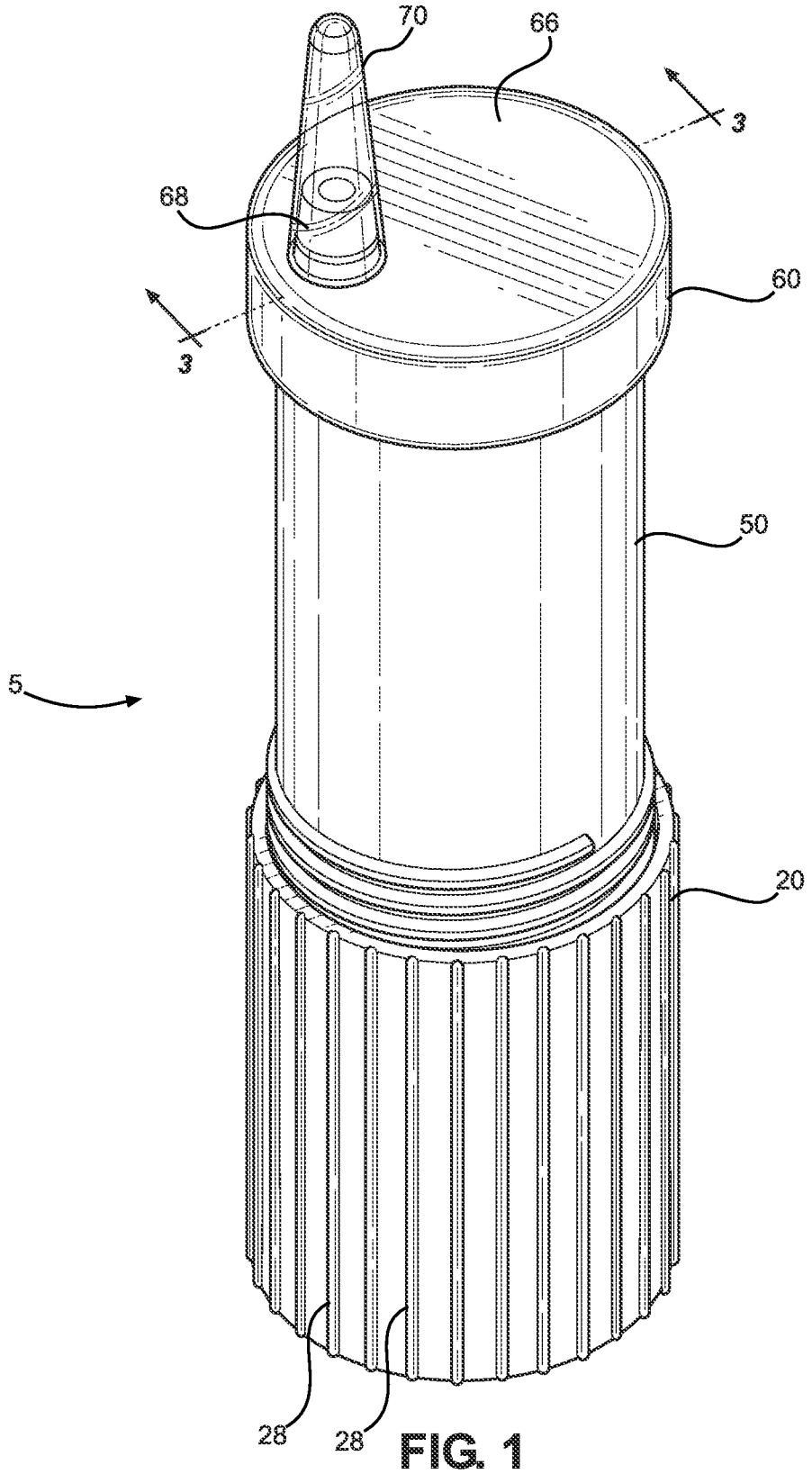
FIG. 1 is a perspective view of hydration squirt bottle with plunger actuator collar and plunger located in the most proximal position which is the position of plunger when hydration squirt bottle is full and ready to squirt the first drink of water or beverage.
Figure 2:
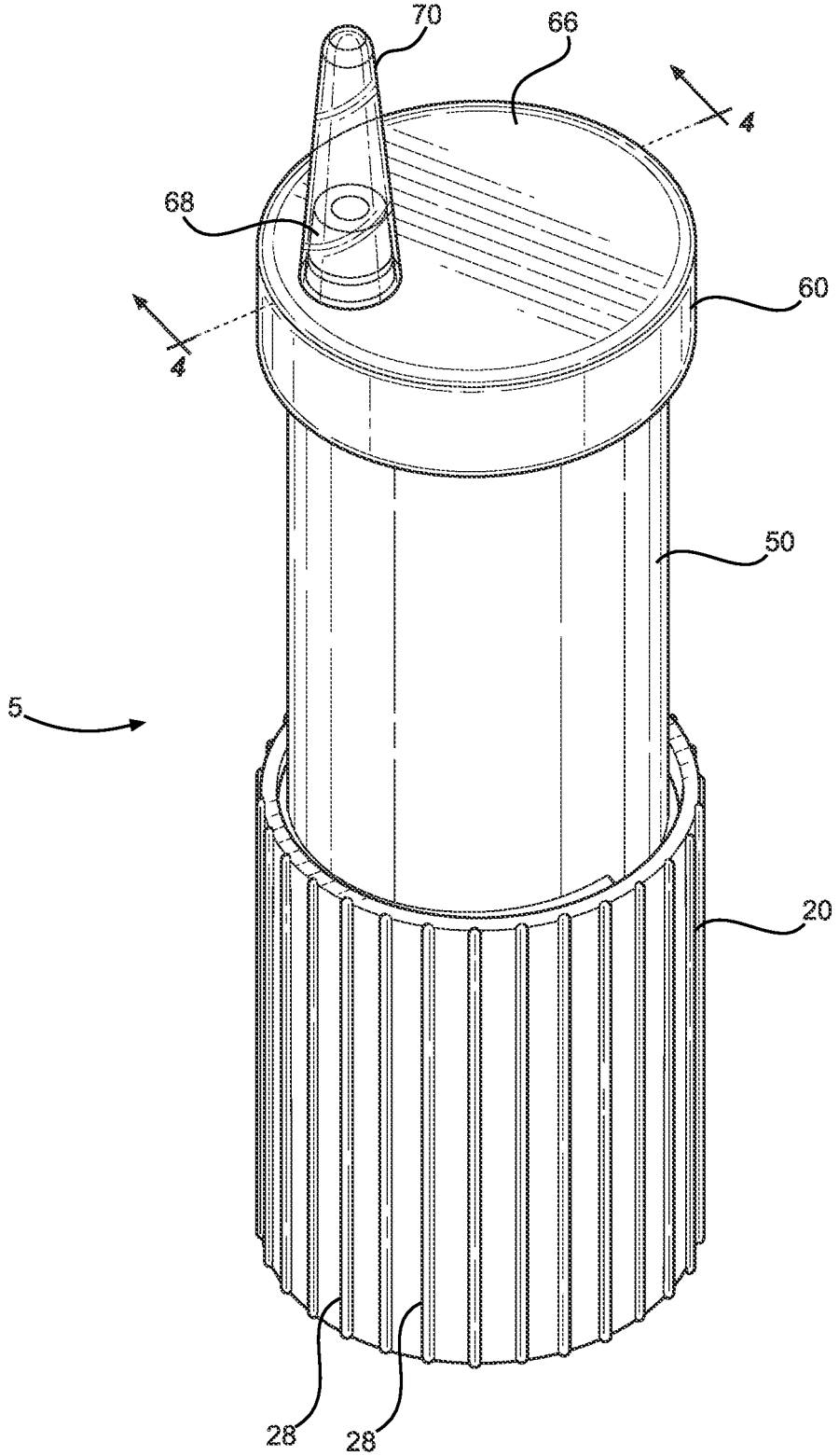
FIG. 2 is a perspective view of hydration squirt bottle with plunger actuator collar and plunger located in a position after several clockwise rotations of plunger actuator collar have occurred that provided several drinks for the patient.
Figure 3:
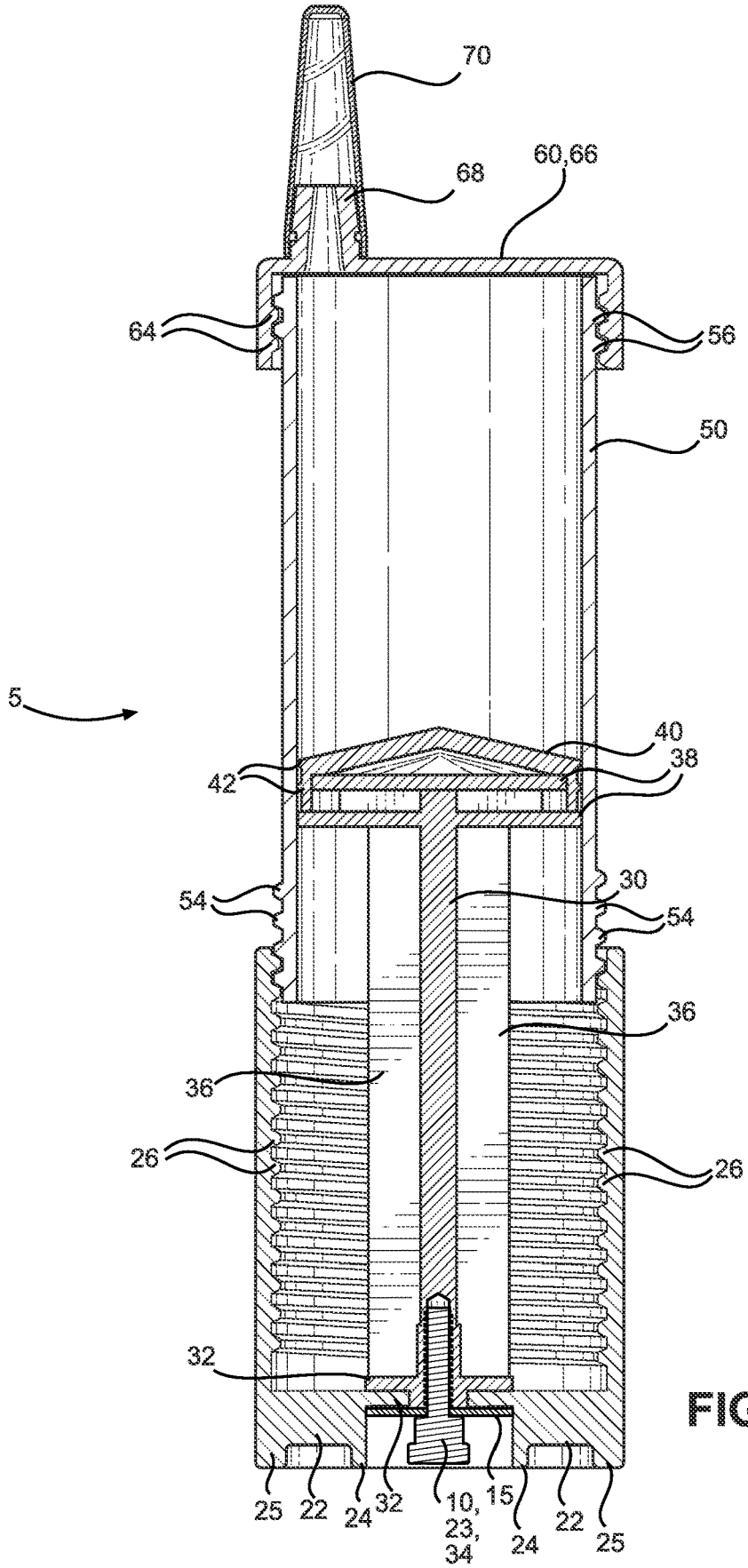
FIG. 3 is a cross sectional view taken from plane 3-3 in FIG. 1.
Figure 4:
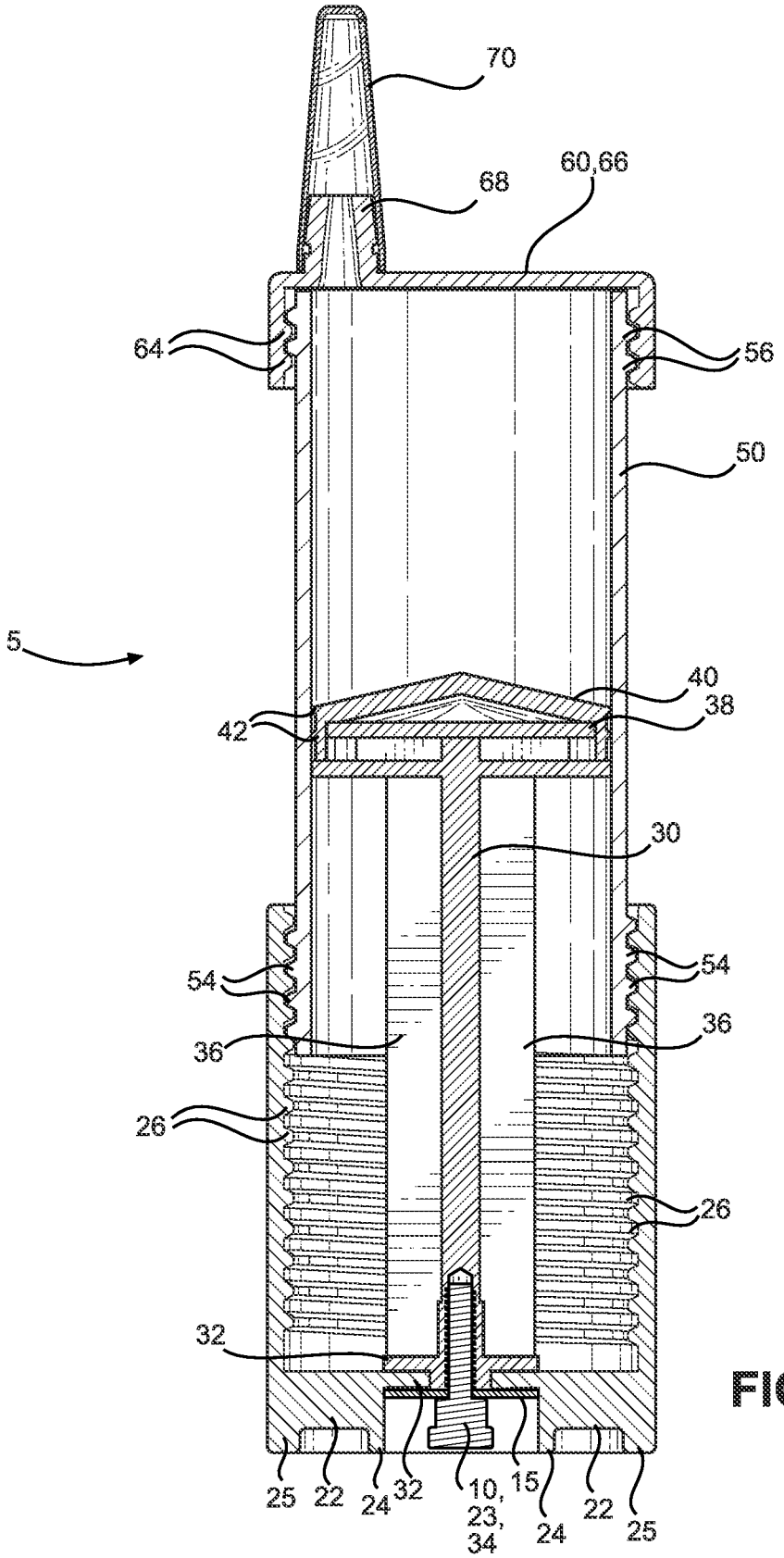
FIG. 4 is a cross sectional view taken from plane 4-4 in FIG. 2.
Figure 5:
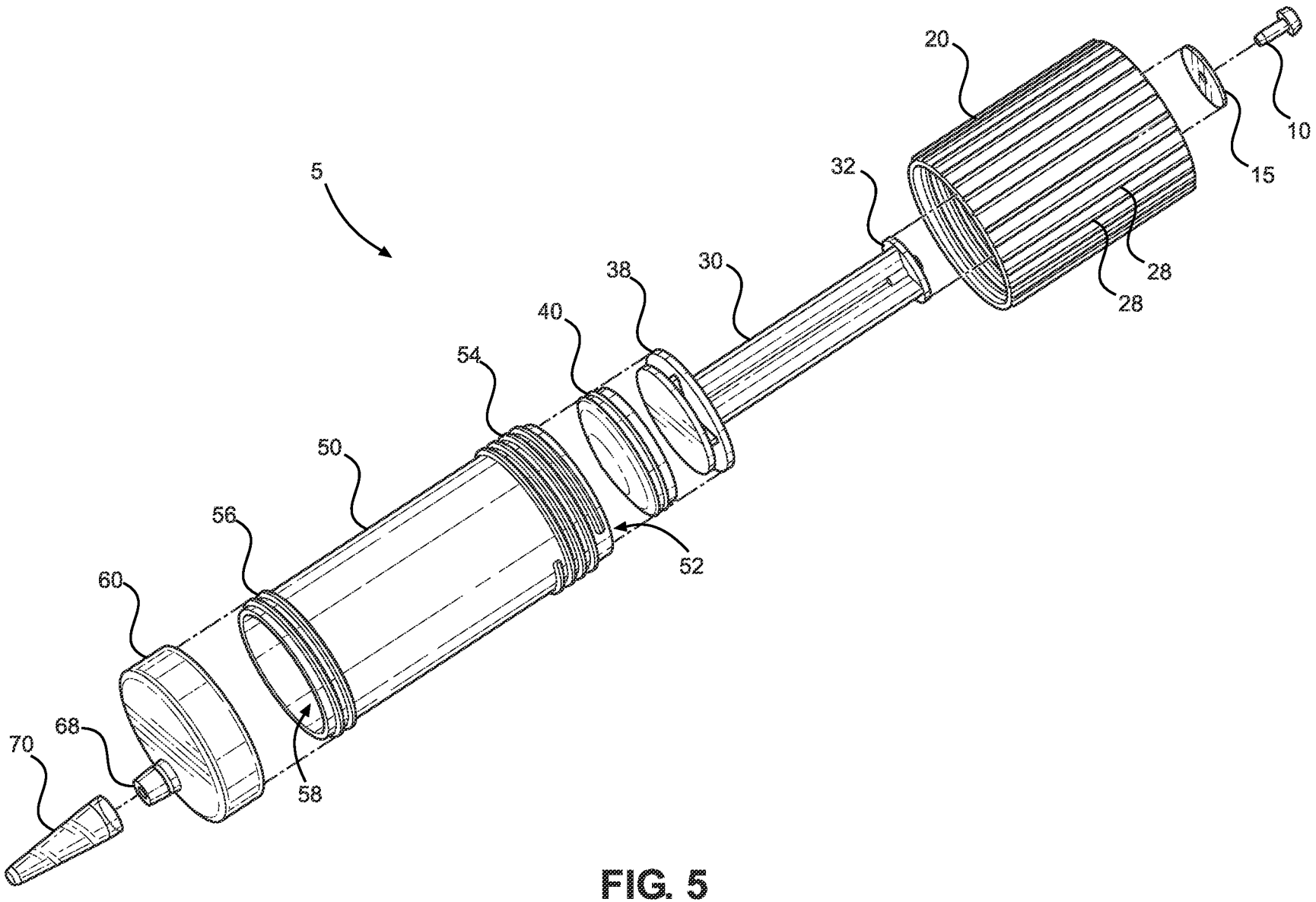
FIG. 5 is an assembly view of hydration squirt bottle.

| Term | Definition |
|---|---|
| 5 | Hydration Squirt Bottle |
| 10 | Screw or Bolt |
| 15 | Washer |
| 20 | Plunger Actuator Collar (PAC) |
| 22 | Closed Proximal End of PAC |
| 23 | Screw Hole on Closed Proximal End |
| 24 | Inner Circular Ridge on Closed Proximal End |
| 25 | Outer Circular Ridge on Closed Proximal End |
| 26 | Helical Thread on PAC |
| 28 | Exterior Ridge or Groove on PAC |
| 30 | Plunger |
| 32 | Screw Flange on Plunger |
| 34 | Screw Hole on Screw Flange |
| 36 | Vertical Rib on Plunger |
| 38 | Head on Plunger |
| 40 | Plunger Seal |
| 42 | Blade on Plunger Seal |
| 50 | Barrel |
| 52 | Open Proximal End of Barrel |
| 54 | Proximal Exterior Helical Thread on Barrel |
| 56 | Distal Exterior Helical Thread on Barrel |
| 58 | Open Distal End of Barrel |
| 60 | Cap |
| 64 | Helical Thread on Cap |
| 66 | Closed Distal End of Cap |
| 68 | Spout on Closed Distal End of Cap |
| 70 | Spout Cover |

DETAILED DESCRIPTION OF THE INVENTION

Throughout this specification, the terms proximal and distal are used. Proximal is defined as the end of the instrument or item that is closest to the caregiver or person using the hydration squirt bottle 5. Distal is defined as the end of the instrument or item that is farthest from the caregiver or person handling or using the hydration squirt bottle 5. Thus the distal end is opposite from the proximal end and vice versa. Hydration squirt bottle 5 is typically used by a caregiver that handles the hydration squirt bottle 5 and squirts the beverage into the patient's mouth. With this frame of reference, the proximal end is the bottom of hydration squirt bottle 5 because the bottom is the end of hydration squirt bottle 5 that is closest to the caregiver when the hydration squirt bottle 5 is being used. The distal end is the top of hydration squirt bottle 5 because the top is the end of hydration squirt bottle 5 that is farthest from the caregiver when the hydration squirt bottle 5 is being used. Note that hydration squirt bottle 5 may also be used by one person to give himself or herself a drink.

Hydration squirt bottle 5 comprises: a screw or bolt 10; a plunger actuator collar 20; a plunger 30; a plunger seal 40; a barrel 50; and a cap 60. The components or elements of hydration squirt bottle 5 may be made of metal, plastic, glass, ceramic, wood, composites, or any other known type of material.

Screw or bolt 10 is a fastener or a rigid cylindrical member or a pin with male thread or helical ridges around its exterior surface at one end and a head at the other end. Screw or bolt 10 has a length and an outer diameter. The head on screw or bolt 10 also has a length and an outside diameter. Screw or bolt 10 functions to pivotally attach screw flange 32 on plunger 30 to the closed proximal end 22 on plunger actuator collar 20. This pivotal attachment is required as discussed below to the cause plunger 30 to move laterally as the plunger actuator collar 20 is rotated. Screw or bolt 10 may be made of any known material. In best mode, screw or bolt 10 is made of stainless steel. In best mode, screw or bolt 10 is a thumbscrew with a large head that can be easily grasped to tightened and loosened by the human hand, without requiring any tools such as a driver or wrench. In best mode, hydration squirt bottle 5 further comprises a washer 15. Washer 15 is a flat washer. Washer 15 has an inside diameter, an outside diameter, and a thickness. The inner diameter of washer 15 must be smaller than the outer diameter of the head on screw or bolt 10. Washer 15 is positioned between the head on screw or bolt 10 and the proximal surface of closed proximal end 22 on plunger actuator collar 20 when pivotally attaching the screw flange 32 on plunger 30 to the closed proximal end 22 on plunger actuator collar 20. Washer 15 provides a bearing surface for the head of screw or bolt 10 on which to rotate as the plunger actuator collar 20 is rotated to laterally move plunger 30. Washer 15 is not required for this invention, however, it is included in best mode.

Plunger actuator collar 20 is a rigid cylindrical shaped member with a side, an inner diameter, an interior surface, an outer diameter, an exterior surface, a length, a longitudinal axis, a closed proximal end 22, and an open distal end. The outer diameter of plunger actuator collar 20 is about 1-10 inches. The length of plunger actuator collar 20 is about 2-20 inches. Closed proximal end 22 is a closed end on the rigid cylindrical shaped member of plunger actuator collar 20. Closed proximal end 22 is a rigid planar disk shaped member with a center, an outer diameter, a proximal surface, and a distal surface. The center of closed proximal end 22 has a screw hole 23. Screw hole 23 is a circular hole or void through closed proximal end 22. Screw hole 23 is located at the center of closed proximal end 22. Screw hole 23 has a diameter that must be smaller than the outer diameter of the head on screw or bolt 10 and/or the outer diameter of washer 15. The outer diameter of closed proximal end 22 is contiguous or integral with the side of the rigid cylindrical shaped member of plunger actuator collar 20 so that the outer diameter of the closed proximal end 22 is flush with the exterior surface of plunger actuator collar 20. The proximal surface of closed proximal end 22 may have an inner circular ridge 24 around screw hole 23. Inner circular ridge 24 is a circular shaped ridge or protrusion that is concentric with screw hole 23. Inner circular ridge 24 has an inner diameter, an outer diameter, and a height. The inner diameter of inner circular ridge 24 must be greater than the outer diameter of the head on screw or bolt 10 and/or the outer diameter of washer 15 so that these members may nest within the inner circular ridge 24. The height of inner circular ridge 24 must be greater than the length of the head of screw or bolt 10 plus the thickness of washer 15 so that these members may nest within the inner circular ridge 24. Inner circular ridge 24 provides a recessed area for screw or bolt 10 and washer 15 to lie within, when properly installed, which allows the proximal end of the hydration squirt bottle 5 to stand on a flat surface like a table without teetering on the head of screw or bolt 10. The proximal surface of closed proximal end 22 may have an outer circular ridge 25 at its outer diameter. Outer circular ridge 25 is a circular shaped ridge or protrusion that is concentric with screw hole 23 and inner circular ridge 24. Outer circular ridge 25 has an inner diameter, an outer diameter, and a height. The outer diameter of outer circular ridge 25 is equivalent to that of plunger actuator collar 20 and contiguous with that of plunger actuator collar 20. The height of outer circular ridge 25 is equivalent to that of inner circular ridge 24. Inner and outer circular ridges 24, 25 together provide a stable footing or foundation for the proximal end of the hydration squirt bottle 5 so that the hydration squirt bottle 5 easily stands on a flat surface like a table. The interior surface of plunger actuator collar 20 has helical thread 26 spiraling longitudinally along the entire length of the interior surface of plunger actuator collar 20. Helical thread 26 is a ridge wrapped around the interior surface of plunger actuator collar 20 in the form of a helix along the entire length of the interior surface of plunger actuator collar 20. As discussed below, helical thread 26 on plunger actuator collar 20 functions to mate with proximal exterior helical thread 54 on barrel 50 in order to laterally move plunger actuator collar 20 relative to barrel 50 when plunger actuator collar 20 is rotated relative to barrel 50. In best mode, the exterior surface of plunger actuator collar 20 has a plurality of ridges or grooves 28. Each ridge or groove 28 is a ridge or groove in the exterior surface of plunger actuator collar 20. In best mode, each ridge or groove runs longitudinally from the closed proximal end 22 to the open distal end of plunger actuator collar 20. In best mode, the entire exterior surface of plunger actuator collar 20 has ridges or grooves 28. Ridges or grooves 28 provide friction on the exterior surface of plunger actuator collar 20 in order to allow plunger actuator collar 20 to be more easily grasped by the hand of the health care professional or any other person and rotated in order to squirt an amount of beverage into the patient's mouth. The human hand can more easily grasp onto plunger actuator collar 20 with longitudinal ridges or grooves 28 around the entire exterior surface of plunger actuator collar 20 as depicted.

Note that ridges or grooves 28 are not required for this invention, however, they are included in best mode. In best mode, the exterior surface of plunger actuator collar 20 has markings or graduation marks. As stated, in best mode, hydration squirt bottle 5 ejects or squirts an exact amount of water or beverage per every complete one rotation of plunger actuator collar 20 relative to barrel 50. Thus, it is helpful to have markings or graduation marks on the exterior surface of plunger actuator collar 20 in order to show or indicate exactly when one rotation has been completed. Markings or graduation marks could consist of one or more lines or notches that are conspicuous and visible on the exterior surface of plunger actuator collar 20. Note that markings or graduation marks are not required for this invention, however, they are included in best mode.

Plunger 30 is a rigid oblong member with a proximal end, a distal end, a length, and a longitudinal axis. The length of plunger 30 is about 1 to 10 inches. The proximal end of plunger has a screw flange 32. Screw flange 32 is a rigid planar disk shaped member with a center, an outer diameter, a proximal surface, and a distal surface. The outer diameter of screw flange 32 must be less than the inner diameter of plunger actuator collar 20. The center of screw flange 32 has a screw hole 34. Screw hole 34 is a circular hole or void through screw flange 32. Screw hole 34 is located at the center of screw flange 32. Screw hole 34 sized to mate with thread on screw or bolt. Screw hole 34 may have female thread that is sized to mate with the male thread on screw or bolt or just may be an unthreaded hole that accepts and engages with screw or bolt 10. Screw or bolt is used to pivotally attach the proximal end of screw flange 32 to the distal surface of closed proximal end 22 of plunger actuator collar 20. Screw or bolt is inserted through screw hole 23 on plunger actuator collar 20 and into screw hole 34 on screw flange 32 on plunger 30 and only tightened to semi loose position that allows the screw flange 32 and closed proximal end 22 to rotate relative to one another. Pivotal attachment is such that the plunger 30 may rotate along its longitudinal axis as plunger 30 is moved laterally in and out of barrel 50 as plunger actuator collar 20 is rotated. The distal end of plunger 30 has a head 38. Head 38 is a rigid planar disk shaped member with a center, an outer diameter, a proximal surface, and a distal surface. The outer diameter of head 38 must be sized to make a slip fit with the inner diameter of barrel 50 or sized just slightly smaller than the inner diameter of barrel 50. The outer diameter of head 38 is larger than that of screw flange 32. The distal surface of screw flange 32 is rigidly connected to the proximal surface of head 38 by four vertical ribs 36. Each vertical rib 36 is a rigid planar member with a proximal end, a distal end, and a length. The proximal end of each vertical rib 36 is rigidly attached to the distal surface of screw flange 32. The distal end of each vertical rib 36 is rigidly attached to the proximal surface of head 38. The four vertical ribs 36 function to rigidly connect screw flange 32 to head 38 so that the plane of screw flange 32 is parallel with that of head 38 and remain that way as plunger 30 moved laterally in and out of barrel 50 as plunger actuator collar 20 is rotated.

Plunger seal 40 is an elastomeric or flexible cylindrical shaped member with a side, an inner diameter, an interior surface, an outer diameter, an exterior surface, a length, a longitudinal axis, an open proximal end, and a closed open distal end. Plunger seal 40 is reversibly attachable to the distal surface of head 38. The inner diameter of plunger seal 40 is sized to make a press fit or an interference fit with the outside diameter of head 38 so that the open proximal end of plunger seal 40 may be pressed onto or snapped over the outside diameter of head 38 to reversibly attach there to. Plunger seal 40 may be attached to head 38 by grabbing and pulling on it to stretch it over head 38 to install it over head 38. Plunger seal 40 may be removed from head 38 by grabbing and pulling on it to stretch it off of head 38 to pull it off of head 38. This is possible since plunger seal 40 is elastomeric or flexible. Plunger seal 40 is reversibly attachable to the distal surface of head 38 in order to allow for replacement of plunger seal 40. Plunger seal 40 is a wear item that may wear out because it continuously rubs against the interior surface of barrel 50. The exterior surface of the side of plunger seal 40 includes one or more blades 42. Each blade 42 is a raised edge or ridge around the entire exterior surface of the side of plunger seal 40. Each blade 42 runs around the entire circumference of the exterior surface of the side of plunger seal 40. Each blade is integral to plunger seal 40 and thus made of the same elastomeric or flexible. Each blade 42 has an outer diameter that is sized to make a press fit or an interference fit with the inner diameter of barrel 50. The outer diameter of each blade 42 is slightly larger than the inner diameter of barrel 50. Plunger seal 40 functions to make a liquid tight slideable connection with the inside surface of barrel 50 as the plunger 30 is moved laterally in and out of barrel 50. Each blade 42 wipes the interior surface of barrel 50 as the plunger 30 is moved laterally in and out of barrel 50. In best mode, plunger seal 40 has two blades 42 as depicted. The closed distal end of plunger seal 40 is integral to the side of plunger seal 40 to make a liquid tight connection there between. In best mode, as depicted, head 38 may further comprise a second rigid planar disk shaped member with a center, an outer diameter, a proximal surface, and a distal surface. In this mode, the proximal surface of the second rigid planar disk shaped member is rigidly attached to the distal surface of the first rigid planar disk shaped member. In this mode, the plunger seal 40 is attached to the distal surface of the second rigid planar disk shaped member. In this mode, Barrel 50 is a is a rigid cylindrical shaped member with a side, an inner diameter, an interior surface, an outer diameter, an exterior surface, a length, a longitudinal axis, an open proximal end 52, and an open distal end 58. The outer diameter of barrel 50 is sized to make a clearance fit with the inner diameter of plunger actuator collar 20. The outer diameter of barrel 50 is slightly smaller than the inner diameter of plunger actuator collar 20. The length of barrel 50 is about 2-20 inches. There is proximal exterior helical thread 54 located on the exterior surface of barrel 50 at the proximal end. Proximal exterior helical thread 54 is helical thread spiraling longitudinally along the exterior surface of the barrel 50 at the proximal end of barrel 50. Helical thread is a ridge wrapped around the exterior surface of barrel 50 in the form of a helix. Proximal exterior helical thread 54 starts at the proximal end of barrel 50 and extends about 0.5 to 5 inches from the proximal end. Proximal exterior helical thread 54 is sized to mate with helical thread 26 on plunger actuator collar 20. Proximal exterior helical thread 54 functions in tandem with helical thread 26 on plunger actuator collar 20 to cause the plunger actuator collar 20 to move relative to barrel 50 when the plunger actuator collar 20 is rotated relative to barrel 50. As plunger actuator collar 20 is rotated clockwise, as viewed from the proximal end, this causes the plunger actuator collar 20 to tighten down or insert into the open proximal end 52 of the barrel 50. In this way, rotating the plunger actuator collar 20 clockwise causes water or beverage contained in hydration squirt bottle 5 to be ejected or squirted out of spout 68. As plunger actuator collar 20 is rotated counterclockwise, as viewed from the proximal end, this causes the plunger actuator collar 20 to loosen up or extend from the open proximal end 52 of the barrel 50. In this way, rotating the plunger actuator collar 20 counterclockwise causes water or beverage to be sucked into hydration squirt bottle 5 through spout 68. There is distal exterior helical thread 56 located on the exterior surface of barrel 50 at the distal end. Distal exterior helical thread 56 is helical thread spiraling longitudinally along the exterior surface of the barrel 50 at the distal end of barrel 50. Helical thread is a ridge wrapped around the exterior surface of barrel 50 in the form of a helix. Distal exterior helical thread 56 starts at the distal end of barrel 50 and extends about 0.5 to 5 inches from the distal end. Distal exterior helical thread 56 is sized to mate with helical thread 64 on cap 60. In best mode, the exterior surface of barrel 50 has markings or graduation marks. As described below, in best mode, hydration squirt bottle 5 ejects or squirts an exact amount of water or beverage per every complete one rotation of plunger actuator collar 20 relative to barrel 50. Thus, it is helpful to have markings or graduation marks on the exterior surface of barrel 50 in order to show or indicate exactly when one rotation has been completed. Markings or graduation marks could consist of one or more lines or notches that are conspicuous and visible on the exterior surface of barrel 50. Note that markings or graduation marks are not required for this invention, however, they are included in best mode.

Cap 60 is a rigid cylindrical shaped member with a side, an inner diameter, an interior surface, an outer diameter, an exterior surface, a length, a longitudinal axis, an open proximal end, and a closed distal end 66. The outer diameter of cap 60 is equivalent to that of plunger actuator collar 20. The length of cap 60 is about 0.2-2 inches. The interior surface of cap 60 has helical thread 64 spiraling longitudinally along the entire length of the interior surface of cap 60. Helical thread 64 is a ridge wrapped around the interior surface of cap 60 in the form of a helix along the entire length of the interior surface of cap 60. Helical thread 64 is sized to mate with distal exterior helical thread 56 on barrel 50. Helical thread 64 functions to mate with distal exterior helical thread 56 on barrel 50 in order to reversibly attach cap 60 to barrel 50. The open proximal end of cap 60 is screwed onto distal exterior helical thread 56 in order to attached cap 60 to barrel 50. This attachment must be a liquid tight connection between these members. The open proximal end of cap 60 is unscrewed off of the distal exterior helical thread 56 in order to remove cap 60 from barrel 50. Closed distal end of cap 60 is a closed end on the rigid cylindrical shaped member of cap 60. Closed end is a rigid planar disk shaped member with a center, an outer diameter, a proximal surface, and a distal surface. The outer diameter of closed end is contiguous or integral with the side of the rigid cylindrical shaped member of cap 60 so that the outer diameter of the closed end is flush with the exterior surface and outer diameter of cap 60 to make a liquid tight connection there between. The distal surface of closed distal end of cap 60 has a spout 68. Spout 68 is a rigid cylindrical member with a side, an inner diameter, an interior surface, an outer diameter, an exterior surface, a length, a longitudinal axis, an open proximal end, and an open distal end. The length of cap 60 is about 0.2 to 2 inches. The longitudinal axis of cap 60 is parallel or at an angle with the longitudinal axis of barrel 50. The open proximal end of spout 68 is rigidly attached to the distal surface of the closed distal end of cap 60 to make a liquid tight connection therewith. The open proximal end of spout 68 passes right through to the proximal surface of the closed distal end of cap 60 so that there is an open channel or path way for liquid to flow through the closed distal end 66 to barrel 50. Spout 68 is an open flow channel or pathway for liquid to flow. The open distal end of spout 68 is placed inside of the person's mouth or close to the person's mouth in order for the person to drink from the hydration squirt bottle 5 and to use the hydration squirt bottle 5.

In best mode, as depicted, hydration squirt bottle 5 may further comprise spout cover 70. Spout cover 70 is a rigid cylindrical shaped member with a side, an inner diameter, an interior surface, an outer diameter, an exterior surface, a length, a longitudinal axis, an open proximal end, and a closed distal end 66. The inner diameter of spout cover 70 is sized to make a press fit or interference fit with the outer diameter of spout 68. The length of cap 60 is about 0.2-2 inches. Spout cover 70 is reversibly attachable to spout 68. Spout cover 70 is pressed or snapped onto or over the distal end of spout 69 to form a liquid tight connection there with. Spout cover 70 functions to prevent water or beverage contained inside of hydration squirt bottle 5 from leaking or spilling out of the spout 68 on hydration squirt bottle 5 when hydration squirt bottle 5 is upside down or sideways. The spout cover 70 must be removed in order to use hydration squirt bottle 5 or to take a drink from hydration squirt bottle 5. In best mode, the inside diameter of spout cover 70 may have a snap ridge or ridge around the inside diameter located adjacent to the proximal end of spout cover 70, as depicted. Also, in best mode, the outside diameter of spout 68 may have a snap groove or groove around the outside diameter located adjacent to the proximal end of spout 68, as depicted. snap ridge or ridge in spout cover 70 snaps into or locks into the snap groove or groove in spout n68 to snap or lock these members together. Spout cover 70 is not required for this invention, however, it is included in best mode.

Hydration squirt bottle 5 is properly configured and used as follows. The screw flange 32 on plunger 30 is reversibly attached to the distal surface of the closed proximal end 22 of plunger actuator collar 20 using screw or bolt 10. As stated, this attachment is a pivotal attachment where the plunger actuator collar 20 may rotate relative to plunger 30 however the screw flange 32 remains adjacent and contiguous with the distal surface of the closed proximal end 22 of plunger actuator collar 20 during the rotation. The head 38 of plunger 30 along with the plunger seal 40 attached to the head 38 is then inserted into the open proximal end of barrel 50. Next the helical thread 26 at the distal end of plunger actuator collar 20 is then started, threaded, or engaged onto the proximal exterior helical thread 54 on barrel 50, which causes the plunger seal 40 to penetrate the open proximal end of barrel 50 to form a liquid tight press fit or interference fit with barrel 50. At this point, hydration squirt bottle 5 may be filled with water or other beverage through the open distal end 58 of barrel 50. Next, the open proximal end of cap 60 is placed onto the open distal end 58 of barrel 50 and the helical thread 64 on cap 60 is then started, threaded, or engaged onto the distal exterior helical thread 56 on barrel 50. Cap 60 is then tightened down onto barrel 50 to form a liquid tight connection therewith. Now the hydration squirt bottle 5 may be used to take a drink by rotating the plunger actuator collar 20 clockwise as viewed form the proximal end in order to squirt water or beverage out of the spout 68 on cap 60. The rotation of plunger actuator collar 20 clockwise causes the plunger 30 and the plunger seal 40 to move towards the distal end of barrel 50 causing water or beverage to squirt out of the spout 68.

A plurality of drinks may be taken from hydration squirt bottle 5 before it is empty or depleted of water or beverage. When the plunger 30 and the plunger seal 40 reaches the proximal surface of the closed distal end 66 of cap 60 after a plurality of clockwise rotations of plunger actuator collar 20, the hydration squirt bottle 5 is empty and must be refilled with water or beverage to use it again. In order to do this, the cap 60 may be removed and the plunger 30 and the plunger seal 40 may be retracted back to the original position by rotating the plunger actuator collar 20 counterclockwise until the plunger 30 and the plunger seal 40 is retracted back to the proximal end of barrel 50. Next more water or beverage is poured into the open distal end 58 of barrel 50 to refill the barrel with water or beverage. Then the cap 60 is reattached and the hydration squirt bottle 5 is ready for use again. Another way to refill hydration squirt bottle 5 is to leave cap 60 attached to barrel 50 and simply dip the distal end of spout 68 into a larger cup of water or beverage and rotate the plunger actuator collar 20 counterclockwise to suck water or beverage into the barrel 50 to refill the barrel with water or beverage. The plunger actuator collar 20 would be rotated several counterclockwise turns until the plunger 30 and the plunger seal 40 is retracted back to the proximal end of barrel 50 at which point the hydration squirt bottle would then be full of water or beverage and capable of using again.

What claimed is:

1. A hydration squirt bottle comprising: a screw or bolt; a plunger actuator collar; a plunger; a plunger seal; a barrel; and a cap, wherein, said screw or bolt is a fastener or a rigid solid cylindrical member with male thread or helical ridges at a first end and a head at a second end, said plunger actuator collar is a rigid hollow cylindrical shaped member with a side, an inner diameter, an interior surface, an outer diameter, an exterior surface, a length, a longitudinal axis, a closed proximal end, and an open distal end, said closed proximal end of said plunger actuator collar has a center, and a proximal surface, and a distal surface, said center of said closed proximal end of said plunger actuator collar has a screw hole, said interior surface of said plunger actuator collar has a helical thread spiraling longitudinally along said length of said plunger actuator collar, said plunger is a rigid oblong member with a proximal end, a distal end, a length, and a longitudinal axis, said proximal end of said plunger has a screw flange, said screw flange is a rigid planar disk shaped member with a center, an outer diameter, a proximal surface, and a distal surface, said center of said screw flange has a screw hole, said distal end of said plunger has a head, said head on said plunger is a rigid planar disk shaped member with a center, an outer diameter, a proximal surface, and a distal surface, said plunger seal is an elastomeric or flexible hollow cylindrical shaped member with a side, an inner diameter, an interior surface, an outer diameter, an exterior surface, a length, a longitudinal axis, an open proximal end, and a closed open distal end, said barrel is a is a rigid hollow cylindrical shaped member with a side, an inner diameter, an interior surface, an outer diameter, an exterior surface, a length, a longitudinal axis, an open proximal end, and an open distal end, said exterior surface of said barrel has a proximal exterior helical thread and a distal exterior helical thread, said proximal exterior helical thread on said barrel is a helical thread spiraling longitudinally along said exterior surface of said barrel at said proximal end of said barrel, said distal exterior helical thread on said barrel is a helical thread spiraling longitudinally along said exterior surface of said barrel at said distal end of said barrel, said cap is a rigid hollow cylindrical shaped member with a side, an inner diameter, an interior surface, an outer diameter, an exterior surface, a length, a longitudinal axis, an open proximal end, and a closed distal end, said interior surface of said cap has a helical thread spiraling longitudinally along said length of said cap, said closed distal end of said cap is a rigid planar disk shaped member with a center, a proximal surface, and a distal surface, said distal surface of said closed distal end of said cap has a spout, said spout is a rigid cylindrical member with a side, an inner diameter, an interior surface, an outer diameter, an exterior surface, a length, a longitudinal axis, an open proximal end, and an open distal end, said open proximal end of said spout is rigidly attached to said distal surface of said closed distal end of said cap, said open proximal end of said plunger seal is reversibly attachable to said distal surface of said head on said plunger, said outer diameter of said plunger seal is sized to make a press fit or an interference fit with said inner diameter of said barrel, said outer diameter of said barrel is sized to make a clearance fit with said inner diameter of said plunger actuator collar, said proximal exterior helical thread on said barrel is sized to mate with said helical thread on said plunger actuator collar, said distal exterior helical thread on said barrel is sized to mate with said helical thread on said cap, said proximal surface of said screw flange on said plunger is pivotally attached to said distal surface of said closed proximal end of said plunger actuator collar by inserting said screw or bolt into said screw hole on said closed proximal end of said plunger actuator collar and said screw hole on said screw flange on said plunger, said distal end of said plunger actuator collar is attached onto to said proximal end of said barrel by threading said helical thread on said plunger actuator collar onto said proximal exterior thread on said barrel, said proximal end of said cap is attached to said distal end of said barrel by threading said helical thread on said cap onto said distal exterior thread on said barrel, and the clockwise rotation of said plunger actuator collar relative to said barrel causes said plunger seal to move distally toward said distal end of said barrel while keeping a liquid tight connection with said interior surface of said barrel.

* * * * *